US007788831B2

(12) United States Patent
Lyons

(10) Patent No.: US 7,788,831 B2
(45) Date of Patent: Sep. 7, 2010

(54) ZIGZAG CALENDAR

(76) Inventor: Lisa Irene Lyons, 4125 Figueroa Ave., Apt. 115, Los Angeles, CA (US) 90037

( * ) Notice: Subject to any disclaimer, the term of this patent is extended or adjusted under 35 U.S.C. 154(b) by 102 days.

(21) Appl. No.: 11/756,498

(22) Filed: May 31, 2007

(65) Prior Publication Data

US 2007/0277408 A1 Dec. 6, 2007

Related U.S. Application Data

(60) Provisional application No. 60/803,620, filed on May 31, 2006.

(51) Int. Cl.
*G09D 3/00* (2006.01)

(52) U.S. Cl. ..... 40/107; 283/2

(58) Field of Classification Search ..... 40/107, 40/110, 118; 283/2
See application file for complete search history.

(56) References Cited

U.S. PATENT DOCUMENTS

| | | | | |
|---|---|---|---|---|
| 3,864,859 | A * | 2/1975 | Kaufman | 40/107 |
| 4,226,443 | A * | 10/1980 | Brown | 283/2 |
| 4,540,292 | A * | 9/1985 | Rubenstein et al. | 368/29 |
| 6,116,656 | A * | 9/2000 | Glassman | 283/114 |
| 6,705,646 | B1 * | 3/2004 | Glassman | 283/2 |

* cited by examiner

*Primary Examiner*—Joanne Silbermann
(74) *Attorney, Agent, or Firm*—Sheldon Mak & Anderson

(57) ABSTRACT

A calendar that is easy to learn and is more efficient for remembering calendar events in both commercial and non-commercial applications. A method for making a calendar that is easy to learn and is more efficient for remembering calendar events in both commercial and non-commercial applications, as disclosed in this disclosure. A method for using a calendar that is easy to learn and is more efficient for remembering calendar events in both commercial and non-commercial applications.

16 Claims, 3 Drawing Sheets

ZIGZAG CALENDAR

CLAIM OF PRIORITY UNDER 35 U.S.C. §120

The present Application for Patent claims the benefit of U.S. Provisional Patent Application No. 60/803,620, entitled "Calendar," filed May 31, 2006.

FIELD

The present invention pertains to the field of calendars, more specifically to a calendar that is easy to learn and use, and which improves efficiency for remembering calendar events in commercial and non-commercial applications.

BACKGROUND

A calendar is a system for organizing and identifying periods of time, typically days, and the names of such identified periods of time are known as calendar dates. Cycles in a calendar are often synchronized with the perceived motion of astronomical objects. A calendar can be a physical device (often paper) that illustrates the system, such as, for example, a desktop calendar or a computer program.

The primary practical uses of a calendar are to identify days, to be informed about and/or to agree on a future event, and to record an event that has happened. Days can be significant for civil, religious or social reasons. For example, a calendar provides a way to determine days that are religious or civil holidays, days that mark the beginning and end of business accounting periods, and days that have legal significance, such as, for example, the day taxes are due or a contract expires. Also a calendar can, by identifying a day, provide other useful information about the day, such as its season.

The calendar in widespread use today is the Gregorian calendar, which is the de facto international standard, and is used almost everywhere in the world for civil purposes, including China and India. The Gregorian calendar is based on a cycle of 400 years, which comprises 146097 days. Since 146097 is evenly divisible by 7, the Gregorian calendar exactly repeats after 400 years. Dividing 146097 by 400 yields an average length of 365.2425 days per calendar year, this is a close approximation to the length of the tropical year. The Gregorian calendar has no inherent dependence on the seven-day week, but in Western society the two are used together, and calendar tools indicate both the Gregorian date and the day of week.

Advantageously, the Gregorian calendar is good for a span of several thousand years, consisting of fourteen one-year calendars, plus a table to show the one-year calendar that is to be used for a given year.

Disadvantageously, however, the Gregorian calendar fails to indicate the dates of moveable holidays such as Christmas and Easter. Further disadvantageously, the current implementations of the Gregorian calendar make it difficult to remember the number of days in a given month, the first day of the month, the last day of the month and the day of the week. Calendar users sometimes remember the number of days in each month of the Gregorian calendar by the use of the traditional mnemonic verse: "Thirty days has (or hath) September, April, June, and November. All the rest have thirty-one, except for February, which has twenty-eight." A leap year comes once every four years and adds one more day to February. Alternate endings include: "excepting February alone, which has but twenty-eight, in fine, till leap year gives it twenty-nine;" "which has eight and a score, until leap year gives it one day more;" "which has (or hath) twenty-eight days clear, and twenty-nine in each leap year;" and "when short February's done, all the rest have thirty-one." A language-independent alternative is to hold up two fists with the index knuckle of the left hand against the index knuckle of the right hand. Then, starting with January from the little knuckle of your left hand, count knuckle, space, knuckle through the months. A knuckle represents a month of 31 days, and a space represents a short month of either 30 days or February with 28 or 29 days depending upon leap year. Further disadvantageously, the Gregorian calendar is not perpetual as each year starts on a different day of the week, calendars expire every year, the months are not equal in length, and it is difficult to determine the weekday of any given day of the year.

Although there are many versions of the traditional Gregorian calendar in various forms, such as, for example, day planners, personal organizers, desk calendars and monthly wall calendars, many people, including people with learning disabilities, are unable to use these versions successfully. Advantageously, listed at the top of the traditional calendar are the days of the week from left to right beginning with Sunday and ending on Saturday. The days of the month appear consecutively on each square to represent the day of the week. A month that begins on a Sunday, Monday, Tuesday, Wednesday or Thursday will have five week rows. A month that begins on either a Friday or Saturday will have six week rows.

Disadvantageously, many users have trouble remembering what day of the week the month starts and what day of the week the month ends. Further disadvantageously, it is difficult to visualize the current month on a traditional calendar without looking at either a paper or computer version of the calendar. Additionally, users often have difficulty remembering what months have 30 days and what months have 31 days without resorting to rhyming or knuckle counting.

Currently, paper-and-binder personal organizers are increasingly being supplanted by electronic personal digital assistants (PDAs), cellular telephones and personal information management software such as, for example, Palm® by PalmOne, Franklin Planner® by FranklinCovey, OD4Contact® by Objective Decision, Microsoft® Outlook® by Microsoft Corporation and Time Matters® by LexisNexis®. A traditional calendar, either in paper or computer form, displays rows of boxes to represent the weeks in the month in a four week, five week or six week linear calendar.

Advantageously, computerized calendars offer advanced functionality including the display of multiple calendar months, weekly calendars, daily calendars and hourly calendars for scheduling events.

Disadvantageously, computerized versions of the traditional calendar have limited usefulness because the calendar is only accessible when the computing device is active. Further disadvantageously, the traditional calendar is too large to display effectively on mobile devices such as a cellular telephone.

Although there are many versions of the traditional calendar in various forms, such as, for example, day planners and monthly wall calendars, many people are unable to use these variations successfully. Additionally, many people are also unable to remember calendar events due to the complex calculations and variations between calendars.

Therefore, there exists a need for a calendar that is easy to learn and is more efficient for remembering calendar events in both commercial and non-commercial applications and that is not associated with the disadvantages of the prior art.

BRIEF DESCRIPTION OF THE DRAWINGS

These and other features, aspects and advantages of the present invention will become better understood with regard to the following description, appended claims, and accompanying figures where:

DETAILED DESCRIPTION

Figure 1:
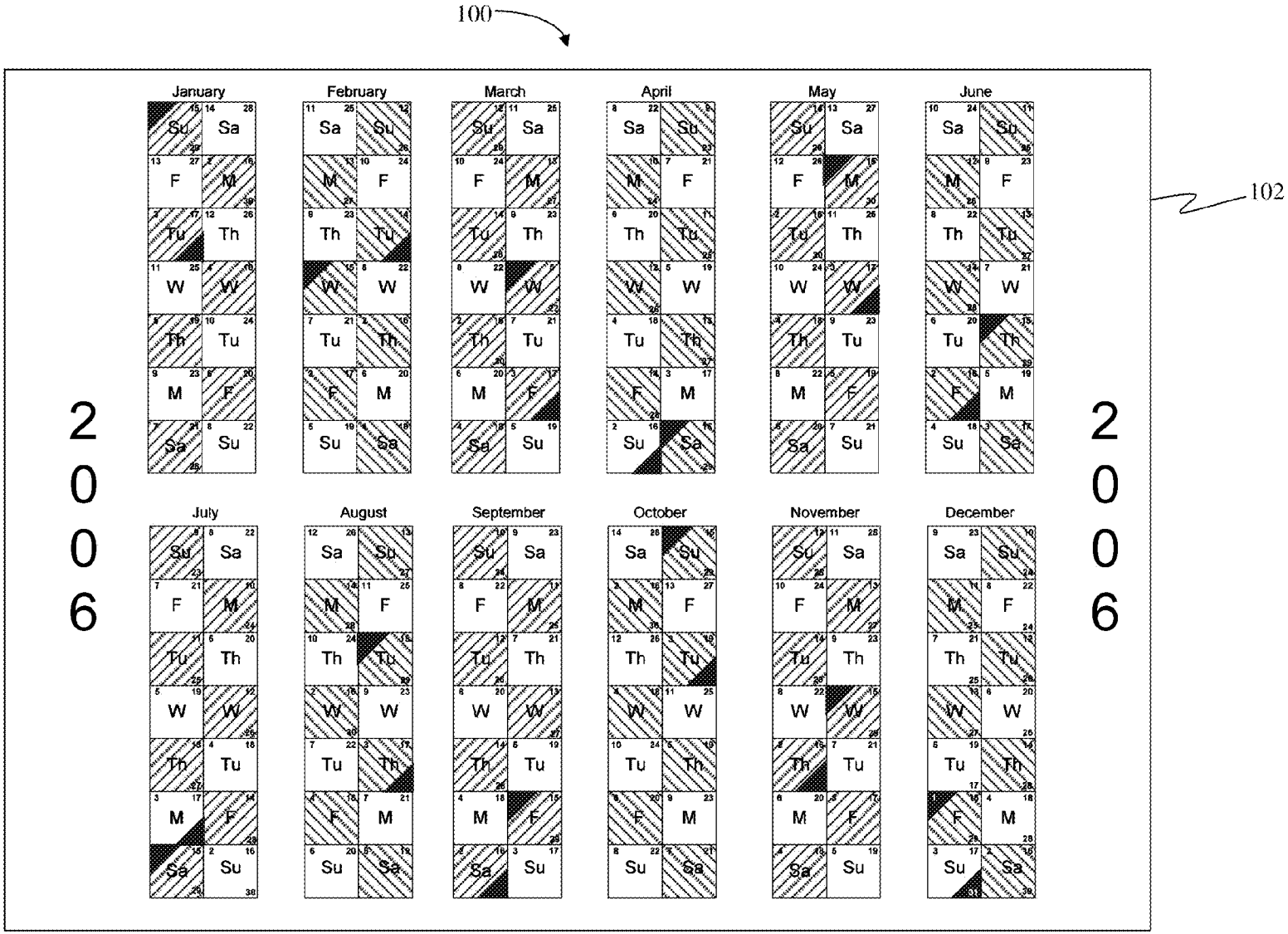
FIG. 1 is a calendar that is easy to learn and is more efficient for remembering calendar events in both commercial and non-commercial applications according to one embodiment of the present invention.

According to one embodiment of the present invention, there is provided a calendar that is easy to learn and is more efficient for remembering calendar events in both commercial and non-commercial applications. According to another embodiment of the present invention, there is provided a method for making a calendar that is easy to learn and is more efficient for remembering calendar events in both commercial and non-commercial applications. According to another embodiment of the present invention, there is provided a computerized method of making a calendar that is easy to learn and is more efficient for remembering calendar events in both commercial and non-commercial applications. In one embodiment, the method comprises, providing a device according to the present invention. The calendar and method will now be disclosed in detail.

The calendar of the present invention is for people that find the traditional linear style calendar does not aid them in remembering dates, appointments, holidays and other calendar events by differentiating the days of the week in a non-linear pattern.

The present invention overcomes the limitations of the prior art by enabling users to easily recall and visualize calendar information using a calendar that is easy to learn and is more efficient for remembering calendar events in both commercial and non-commercial applications that is not associated with these disadvantages.

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by its intended use.

As used in this disclosure, except where the context requires otherwise, the term "comprise" and variations of the term, such as "comprising", "comprises" and "comprised" are not intended to exclude other additives, components, integers or steps.

Throughout the drawings, reference numbers are re-used to indicate correspondence between referenced elements. In addition, the first digit of each reference number indicates the figure in which the element first appears. The following description is provided to enable any person skilled in the art to make and use the invention and sets forth the best modes contemplated by the inventor, but does not limit the variations available.

In the following description, certain terminology is used to describe certain features of one or more embodiments of the invention. The term "perpetual calendar means" refers to any device, program or algorithm for calculating the Gregorian month, day, weekday and date for any given year. The term "zigzag" means a pattern having an angular shape characterized by sharp turns in alternating directions, generally formed by a path between two parallel lines. The term "matrix" means an array of data cells of two or more dimensions. "Box" refers to a data cell in the present calendar system. "Color," unless otherwise indicated or possible in the context in which this term is used, refers to a particular color or to a pattern (such as a pattern of shading) of a color. Different colors are those that are visually distinguishable. An information storage medium refers to either electronic or physical storage devices such as, for example, paper or a computer's hard drive.

Referring now to FIG. 1, there is shown a calendar 100, according to the present invention, that is easy to learn and is more efficient for remembering calendar events in both commercial and non-commercial applications according to one embodiment of the present invention. In one embodiment, twelve months of the calendar 100 can be printed on a single page. In a preferred embodiment, twelve months of the calendar 100 can be viewed on a display screen. In a particularly preferred embodiment, each full month of the calendar 100 comprises at least one matrix in a storage medium such as paper 102 of fourteen day boxes located in at least two columns side by side with seven day boxes in each column. A display zone is centered in each day box to indicate the day of the week. The matrix represents a single month with the name of the month located above the two columns; wherein an odd number month is shaded with a first user selected color starting at the top left day box and alternating with non-shaded boxes in a zigzag pattern; and an even month is shaded with a second user selected color starting at the top right day box and alternating with non-shaded boxes in a zigzag pattern. In a preferred embodiment, the first user selected color is yellow and the second user selected color is light blue. In a more preferred embodiment, the day of the week is located in the center of each of the fourteen boxes; wherein for each odd month Sunday is located in the top left corner box and Saturday is placed in the top left corner box for each even month. In another particularly preferred embodiment, each full month of the calendar 100 comprises fourteen boxes located in two columns side by side displayed on a screen of a computing device.

Figure 2:
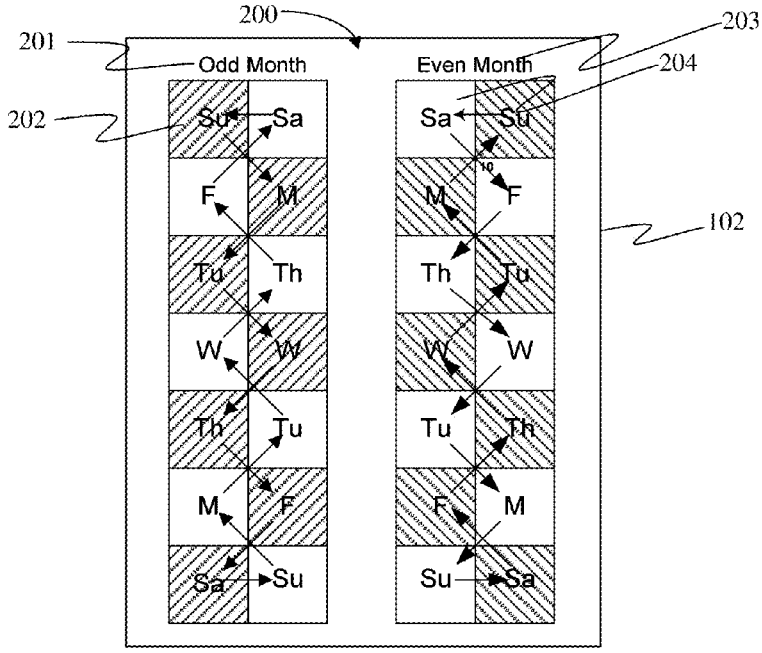
FIG. 2 is a flow diagram showing the path to read the calendar according to FIG. 1.

Referring now to FIG. 2, there is shown a flow diagram depicting a path to read the calendar 100 according to FIG. 1. First, the starting position 202 or 204 is located. Then, if the week is an odd week, the pattern is downward in a zigzag pattern tracing the shaded boxes from the starting position 202. Next, once the bottom of the odd week is reached, the even weeks are traced by the non-shaded day in a zigzag pattern upwards. Then, if the week is an even week, the pattern is downward in a zigzag pattern tracing the non-shaded boxes from the starting position 204. Next, once the bottom of the even week is reached, the odd weeks are traced by the shaded boxes in a zigzag pattern upwards. The first week of a first odd numbered month 201 begins with Sunday on the top left corner of the calendar 100 and the pattern traced zigzags down to Saturday in the bottom left corner of the calendar 100. The first week of a first even numbered month 203 begins with Sunday on the top right corner of the calendar 100 and the pattern traced zigzags down to Saturday in the bottom right corner of the calendar 100.

Figure 3:
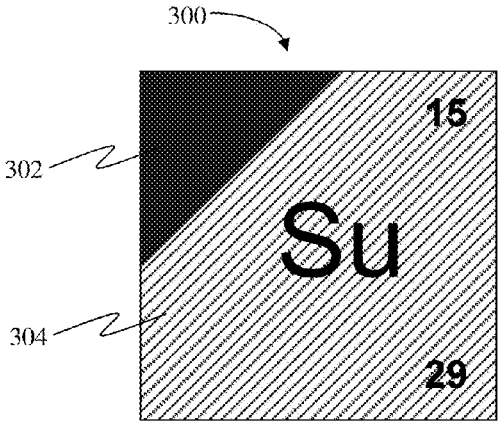
FIG. 3 is a close-up view of a single odd day in the calendar shown in FIG. 1.

Referring now to FIG. 3, there is shown a close-up view of a single odd day box 300 in the calendar 100 shown in FIG. 1. In one embodiment, a user selected colored triangle first day of the month marker 302 is located in the upper left-hand corner of the odd day box 300 to indicate the first day of the month. In another embodiment, a visible user selected colored number "1" is centered within the user selected colored triangle first day of the month marker 302 located in the upper left-hand corner of the odd day box 300 to indicate the first day of the month. In a particularly preferred embodiment, a first day of the month marker 302 is a black shaded triangle in the upper left-hand corner of the odd day box 300 to indicate the first day of the month.

Figure 4:
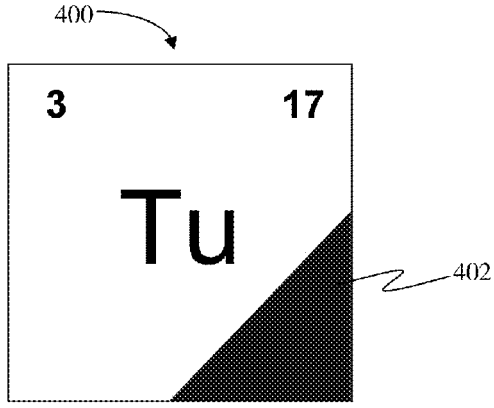
FIG. 4 is a close-up view of a single even day in the calendar shown in FIG. 1.

Referring now to FIG. 4, there is shown a close-up view of a single even day box 400 in the calendar 100 shown in FIG. 1. In one embodiment, a user selected colored triangle last day of the month marker 402 is located in the lower right-hand corner of the even day box 400 to indicate the last day of the month. In another embodiment, a visible user selected colored number corresponding to the number of the last day of the month is centered within the user selected colored triangle last day of the month marker 402 located in the lower right-hand corner of the even day box 400. In a particularly preferred embodiment, a last day of the month marker 402 is shown as a black shaded triangle in the lower right-hand corner of the even day box 400 to indicate the last day of the month. In another embodiment, a last day of the month marker 402 is shown as a black shaded triangle in the lower right-hand corner of an odd day box 300 to indicate the last day of the month.

Figure 5:
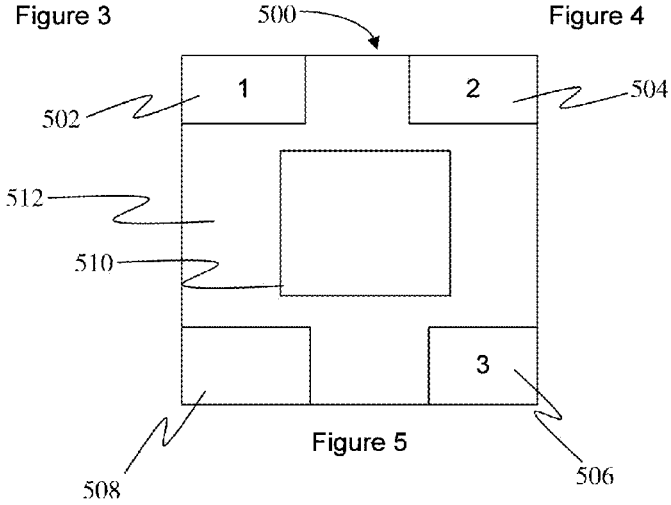
FIG. 5 is a block diagram of four information zones in an expanded view of a single day in the calendar shown in FIG. 1.

Referring now to FIG. 5, there is shown an illustration of four information zones in an expanded view of a single day box 500 in the calendar 100 shown in FIG. 1. In a particularly preferred embodiment, an upper left-hand corner day box section 502, an upper right-hand corner day box section 504 and a lower right-hand corner day box section 506 are arranged inside the day box 500 and are used to indicate the day of the month and the week of the month. In another particularly preferred embodiment, a centered day box section 510 is arranged inside the day box to indicate the day of the week. In another embodiment, a lower left-hand corner day box section 508 is arranged inside the day box and can be used to place calendar event symbols (not shown) to alert the user such as, for example, a bell shaped symbol indicating a meeting. In another embodiment, the remaining blank area 512 of the day box 500 is used to add additional calendar event notifications (not shown). A numerically filled upper left-hand corner day box section 502 in a shaded day box indicates a first week of a month and for each following numerically consecutive day of the first week is located in the same upper left-hand corner day box section 502 following the pattern in FIG. 2. A numerically filled upper left-hand corner day box section 502 in a non-shaded day box 500 indicate a second week of the month and for each following numerically consecutive day of the second week is located in the same upper left-hand corner day box section 502 following the pattern in FIG. 2.

A numerically filled upper right-hand corner day box section 504 in a shaded day box indicates a third week of a month and for each following numerically consecutive day of the third week is located in the same upper right-hand corner day box section 504 following the pattern in FIG. 2. A numerically filled upper right-hand corner day box section 504 in a non-shaded day box indicates a fourth week of the month and for each following numerically consecutive day of the fourth week is located in the same upper right-hand corner day box section 504 following the pattern in FIG. 2.

A numerically filled lower right-hand corner day box section 506 in a shaded day box indicates a fifth week of a month and for each following numerically consecutive day of the fifth week is located in the same lower right-hand corner day box section 506 following the pattern in FIG. 2. A numerically filled lower right-hand corner day box section 506 in a non-shaded day box indicates a sixth week of the month and for each following numerically consecutive day of the sixth week is located in the same lower right-hand corner day box section 506 following the pattern in FIG. 2.

Figure 6:
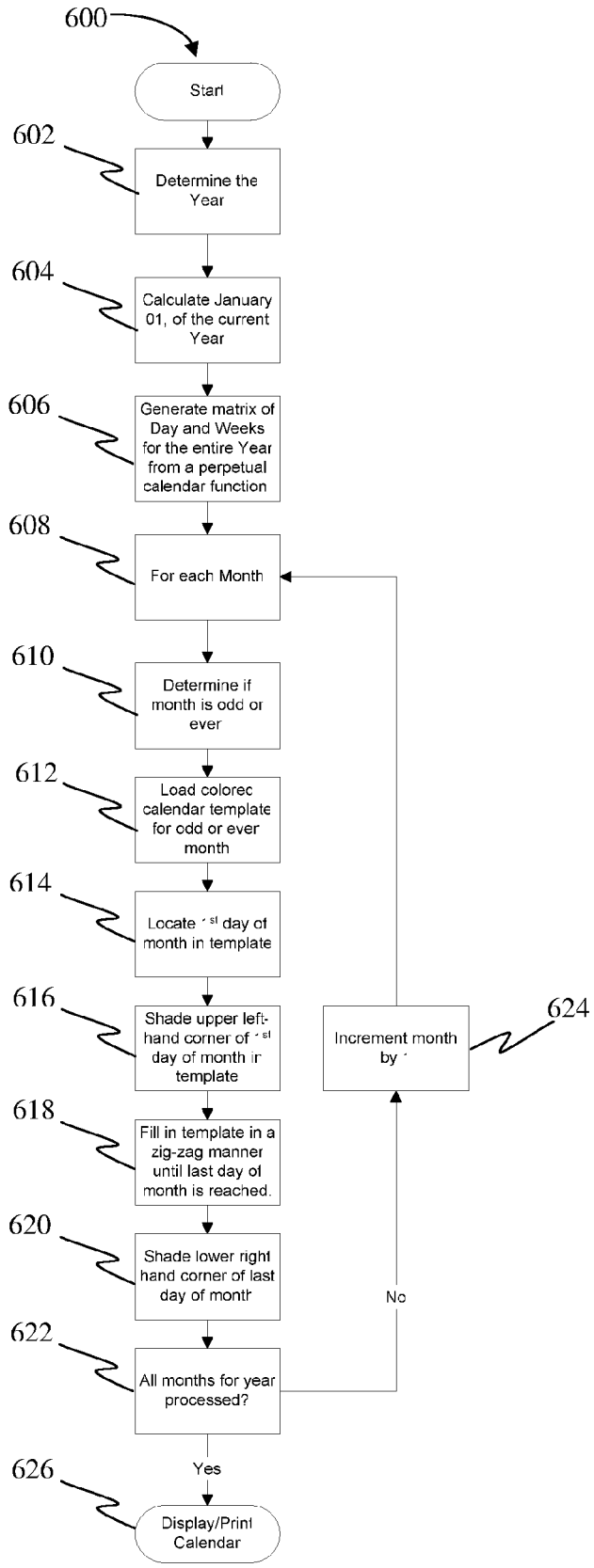
FIG. 6 is a flowchart of a computer program for displaying the calendar shown in FIG. 1.

Referring now to FIG. 6, there is shown a flowchart 600 of a computer program for displaying the calendar 100 shown in FIG. 1. First, a selected year 602 is entered into a computing device by manual means or automatic means. Then, a perpetual calendar means 606 is used to calculate 604 a week and a day of the week for January 1 st of the selected year. Next, a fourteen-by-two-by-twelve database matrix comprising a day name, a day number, a month number, a month name, an odd month indicator, an even month indicator, a first day indicator, a last day indicator, an odd month color and an even month color is populated 606 in a template of the calendar 100 with the next numerically consecutive 365 days, or 366 days in a leap year, from the perpetual calendar means. Then, for each month 608 the user selected color is added 612 to the database matrix for the odd months 610 and the user selected color is added to the database for the even months 610. Next, the first day of the month is located 614 and the first day indicator in the database matrix is set to a logical true and the upper left-hand corner of the template is shaded 616 black. Then, from the first day indicator the database matrix is populated 618 in a zigzag manner until the last day of the month. Next, the lower right-hand corner of the last day of the month of the template is shaded 620 black. Then, if all twelve months have not been processed 622 the month is increased 624 by 1 and the steps 608-622 are repeated until all twelve months have been processed. Then, the filled calendar 100 is displayed or printed 626.

Although the present invention has been discussed in considerable detail with reference to certain preferred embodiments, other embodiments are possible. Therefore, the scope of the appended claims should not be limited to the description of preferred embodiments contained in this disclosure. All references cited herein are incorporated by reference in their entirety.

What is claimed is:

1. A calendar system in an information storage medium comprising:

(a) a plurality of matrices, each having fourteen day boxes; wherein each matrix represents a month;

(b) at least two columns in each matrix, wherein each of the columns comprises seven day boxes;

the at least two columns comprise a left column and a right column, wherein an odd numbered month is shaded with a first user selected color at a top day box of the left column, and wherein the first user selected color alternates with non-shaded boxes in a downward zigzag pattern; and (c) one or more display zones in each day box to display information in a zigzag manner through the last day of the month.

2. The system of claim 1, wherein the day boxes are square in configuration and wherein the one or more display zones are centered in the day boxes, the display zones indicating the day of the week.

3. The system of claim 1, where the name of a month is located above the at least two columns.

4. The system of claim 1, wherein the at least two columns comprise a left column and a right column, wherein an even numbered month is shaded with a second user selected color at a top box of the right column, and wherein the first user-selected color alternates with non-shaded boxes in a downward zigzag pattern.

5. The system of claim 1, wherein the at least two columns comprise a left column and a right column, and wherein Sunday of each odd numbered month is located in a top day box of the left column of the at least one matrix.

6. The system of claim 1, wherein the at least two columns comprise a left column and a right column, and wherein Saturday of each even numbered month is located in a top day box of the left column of the at least one matrix.

7. The day boxes of claim 1 further comprising:

(a) at least one odd day box;

(b) at least one even day box;

(c) a first marker comprising a colored triangle having a first user selected color in the upper left-hand corner of the odd day box to indicate the first day of a month;

(d) a second marker comprising a colored triangle having a second user selected color in the lower right-hand corner of the even day box to indicate the last day of the month;

(e) a number "1" having the first user selected color centered in the first marker (f) a number corresponding to the number of the last day of the month is centered within the second user selected colored triangle last day of the month marker located in the lower right-hand corner of the even day box; and (g) one or more information zones.

8. The system of claim 1, where a shaded and numerically filled upper left-hand corner day box section indicates a first week of a month and where each following numerically consecutive day of the first week is located in consecutive upper left-hand corner day box sections in a downward zigzag pattern.

9. The system of claim 1, where a non-shaded day box's numerically filled upper left-hand corner day box section indicates a second week of the month and where each following numerically consecutive day of the second week is located in the same upper left-hand corner day box sections in an upward zigzag pattern.

10. The day boxes of claim 9, where the one or more information zones comprise an upper left-hand corner section, an upper right-hand corner section, a lower left-hand corner section and a lower right-hand corner section.

11. The day boxes of claim 9, where the one or more information zones display event symbols, alerts, or symbols and alerts to notify a user of an event.

12. The system of claim 1, where a shaded numerically filled upper right-hand corner day box section indicates a third week of a month and where each following numerically consecutive day of the third week is located in the same upper right-hand corner day box sections in a downward zigzag pattern.

13. The system of claim 1, where a non-shaded numerically filled upper right-hand corner day box section indicates a fourth week of the month and where each following numerically consecutive day of the fourth week is located in the same upper right-hand corner day box sections in an upward zigzag pattern.

14. The system of claim 1, where a shaded numerically filled lower right-hand corner day box section indicates a fifth week of a month and where each following numerically consecutive day of the fifth week is located in the same lower right-hand corner day box sections in an upward zigzag pattern.

15. The system of claim 1, wherein the calendar system is a paper calendar.

16. The system of claim 1, wherein the calendar system is displayed and stored in electronic media.

* * * * *